United States Patent [19]

Harig

[11] Patent Number: 4,706,940

[45] Date of Patent: Nov. 17, 1987

[54] ROPE HOIST APPARATUS

[75] Inventor: Manfred Harig, Bergish Gladbach, Fed. Rep. of Germany

[73] Assignee: Greifzug Hebezeugbau GmbH, Fed. Rep. of Germany

[21] Appl. No.: 839,726

[22] Filed: Mar. 14, 1986

[30] Foreign Application Priority Data

Mar. 19, 1985 [DE] Fed. Rep. of Germany ..... 3509920

[51] Int. Cl.[4] ..... B66D 1/00; B66D 1/30

[52] U.S. Cl. ..... 254/333; 226/190; 242/47.01; 254/371; 254/374; 254/389

[58] Field of Search ..... 254/382, 383, 333, 336, 254/371, 278, 374, 280, 283; 226/190; 242/47.01

[56] References Cited

U.S. PATENT DOCUMENTS

| | | | |
|---|---|---|---|
| 2,907,534 | 10/1959 | Benstein | 254/333 X |
| 3,729,173 | 4/1973 | Levardon | 254/333 |
| 4,005,852 | 2/1977 | Schmitmeyer | 254/383 X |
| 4,205,871 | 2/1980 | Manabe | 254/333 |
| 4,345,741 | 8/1982 | Rinio | 254/371 X |
| 4,555,091 | 11/1985 | May | 254/333 X |

FOREIGN PATENT DOCUMENTS

| | | | |
|---|---|---|---|
| 2441576 | 6/1980 | France | 254/371 |
| 1068251 | 5/1967 | United Kingdom | 254/333 |

*Primary Examiner*—Stuart S. Levy
*Assistant Examiner*—Katherine Matecki

[57] ABSTRACT

Rope hoist apparatus comprising a single driven drive pulley (15) in which the rope (11) is pressed by a spring-loaded lever (32) by two pressure rollers (29 and 30) into the rope groove (19). The pressure rollers (29 and 30) are so arranged that the rope tip (41) of the rope (11) can easily be pushed beneath the pressure rollers (29 and 30). The rope (11) is conducted after being lifted out of the rope groove (19) via a lateral ramp (60) onto a running face (21) of the drive pulley (15) which is disposed adjacent the rope groove (19) and over which the slack run (13) is conducted in a manner preventing damage parallel to the load run (12).

10 Claims, 7 Drawing Figures

Figure 1:
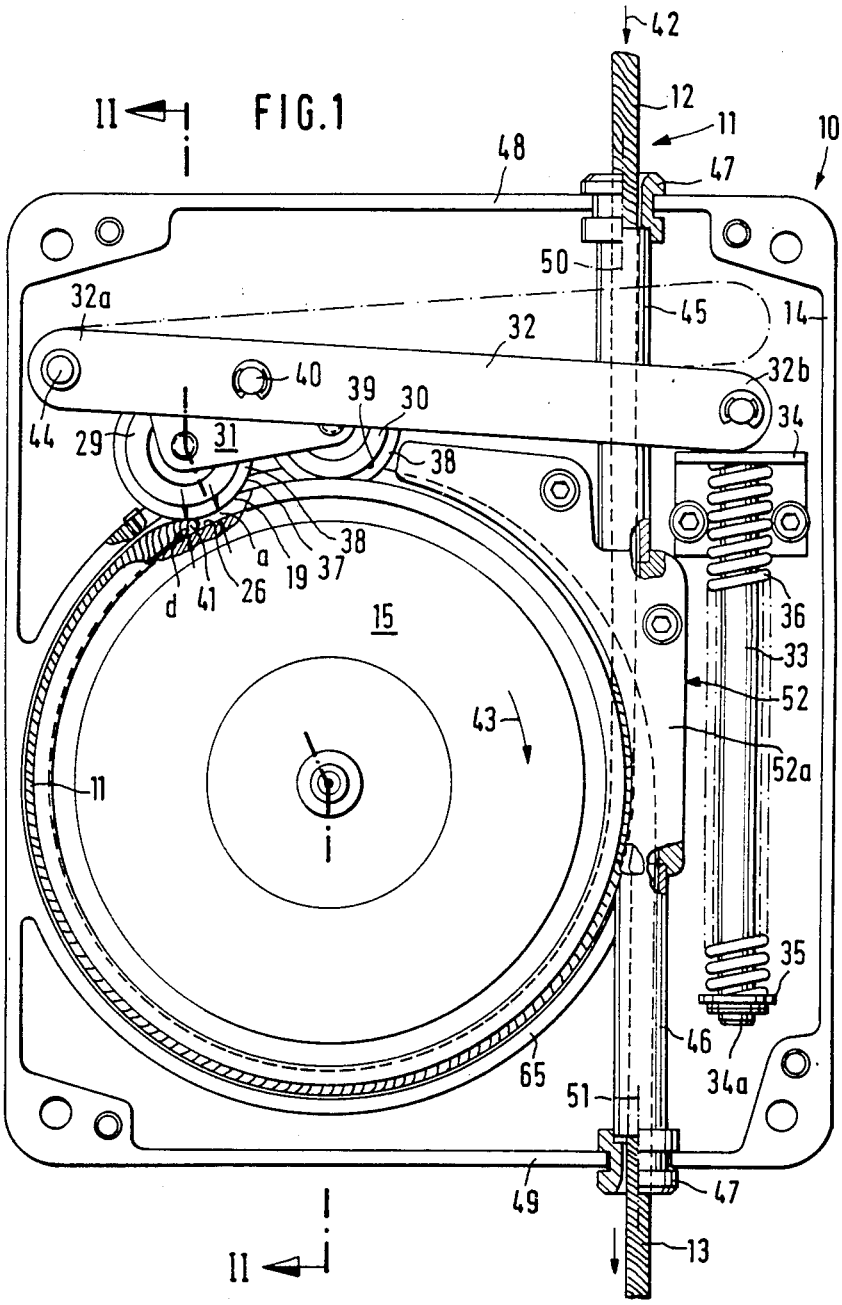

II
42
12
11
10
48
47
50
45
14
32a
32
32b
40
39
30
34
44
29
31
38
38
a
19
37
d
41
26
15
36
33
52
43
52a
11
35
46
34a
65
51
49
47
13
II

ROPE HOIST APPARATUS

The invention relates to a rope hoist apparatus comprising a single driven drive pulley and a continuous rope whose load run passes round the drive pulley and at the end of the wrap is pressed into the V-shaped pulley groove of the drive pulley by two pressure rollers mounted in series in the peripheral direction on a tiltable roller support and whose slack run runs out of the pulley groove behind the pressure rollers adjacent the load run through a guide means.

A rope hoist apparatus or pulley block apparatus of this type is known (CH-PS No. 636,325) in which the roller support is mounted with pressure rollers on a tilt lever which in turn carries control rollers between which the load run of the rope passes with deflection and due to its tension tends to pivot the tilt lever and press the pressure rollers against the rope running in the groove of the drive pulley. The 'slack run', i.e. the part of the rope not under load running from the drive pulley, after leaving the pulley groove is led away tangentially and led over a roller disposed near the rope pulley downwardly, the rope again being bent to a great extent under its own weight.

In the known rope hoist apparatus the rope due to the repeated deflection is subjected to a high load and prone to high wear. It is also difficult to thread the rope into the apparatus. The tangential carrying away of the slack run and the additional guide roller necessary for this purpose require a great deal of space and the slack run of the rope does not have satisfactory guiding.

The problem underlying the invention is to provide a rope hoist apparatus or pulley block apparatus of the type explained in detail at the beginning into which the rope can be easily introduced and in which it is guided in a manner preventing damage and without pronounced bendings, in particular without counterbending on entry and exit, and can enter and leave at the same point of the drive pulley in parallel tangential planes.

This problem is solved with the invention in that the drive pulley beside the pulley groove comprises on its outer periphery a running face and that the guide means is provided with an entry guide disposed tangentially to the rope groove for the load run and with a lateral ramp for the slack run over which the slack run of the rope is conducted onto the running face of the drive pulley.

This configuration has the advantage that neither the load run nor the slack run in the rope hoist apparatus undergoes a counterbending or is bent to a greater degree than at the drive pulley itself. The slack run, which is kept under tension at least by its own weight, can be led over the edge of the drive pulley on the running face thereof vertically downwardly so that the space required is very small.

To ensure that the slack run runs easily out of the pulley groove onto the running face of the drive pulley the groove conveniently has a cross-section asymmetrical with respect to the drive pulley plane and the flank of the pulley groove adjacent the running face has a greater inclination than the flank remote from the running face. In addition, the edge between the running face and its adjacent pulley groove flank may also be made rounded.

To enable an adequately high tensioned force to be transmitted to the rope even under moderate application pressure which is divided by the two pressure rollers amongst several points, a very slim pulley groove has proved convenient. The inclination of the pulley groove flank remote from the running face may be very small and in the extreme case be 0°.

The guide means has in the tension direction of the drive pulley before the lateral ramp preferably a tongue, the tongue tip of which extends up to the rope groove bottom and which forms a radial ramp rising in the peripheral direction of the drive pulley. The tongue tip lifts the rope tip on insertion of the rope and leads it out of the pulley groove until it is conducted via the lateral ramp onto the running face of the drive pulley. In addition, the tongue has the purpose of removing dirt or other foreign material lodged in the pulley groove bottom and thereby always keeping the pulley groove clear over its entire depth.

To conduct the slack run after its exit from the pulley groove into an exit plane parallel to the entering load run the guide means comprises above the running face of the drive pulley a curved first guide face for the back of the slack run which starts in the region of the tongue and terminates at an exit tube. In addition, the entry guide for the load run is conveniently made as entry passage which is followed by a second guide face for the load run which is disposed opposite the groove of the pulley and is followed by the peripheral guard of the rope groove usual in drive pulley mechanisms of the present type.

In the rope drive according to the invention a very slim V groove is used for the rope and consequently even with little wear the rope enters relatively deeply into the rope groove. It is therefore necessary for the pressure rollers to have a pronounced follow-up action. To achieve this the pressure rollers in the pulley drive according to the invention comprises a relatively narrow radial projection introduceable into the pulley groove and the roller support is mounted with the pressure rollers on a spring-loaded lever which can execute a large pivot travel and with adequate length with relatively small spring loading can exert via the presssure rollers an adequate application pressure onto the rope in the rope groove.

It is expedient for the pressure rollers to have at least on one side of their radial projection a radially set back shoulder with which the pressure rollers can bear on the outer periphery, in particular on the running face of the drive pulley. This shoulder, which does not obstruct the penetration of the radial projection of the pressure rollers when the latter in operation press the rope into the V groove of the drive pulley, proves particularly useful on introduction of the rope into the rope hoist apparatus. For this purpose the spring-loaded lever comprises a stop on which it bears prior to the introduction of the rope under spring loading in such a manner that the spacing of the radial projection of the one pressure roller from the rope groove bottom of the pulley disc is equal in size to the thickness of the rope tip whilst the second pressure roller bears with its shoulder on the outer periphery of the drive pulley. Since the rope tip is generally somewhat thinner than the nominal cross-section of the rope the first pressure roller on introduction of the rope tip climbs slightly up the rope, the spring-loaded lever thereby being slightly raised. On further advance of the rope the first pressure roller then already exerts a slight clamping pressure on the rope in the rope groove which suffices to push the rope with rotation of the drive pulley beneath the second pressure roller which thereby raises the lever against the action of its pressure spring, the predetermined application pressure thereby being reached.

Although the application rollers under the action of the spring-loaded lever in the operating condition exert a considerable application pressure on the rope, the application pressure of the first roller on threading the rope in due to the arrangement according to the invention is so small that the rope tip can be introduced easily automatically, i.e. without releasing the pressure means, firstly beneath the first and then beneath the second pressure roller. An easy automatic insertion of the rope in rope hoist apparatuses or rope and pulley mechanisms of the present type is important because said rope hoist apparatuses are frequently used for raising and lowering working platforms on different building sites at frequently changing locations so that the rope frequently has to be pulled out and reintroduced under difficult conditions.

It is apparent that the rope in operation of the rope hoist apparatus according to the invention is subjected only to low wear because it is bent only with the large radius of curvature of the drive pulley and enters the rope groove rectilinearly and can roll over the running face of the drive pulley before it leaves the rope hoist apparatus again. As a result in particular when using the rope hoist apparatus as lifting means for working platforms with large travel and high weight of the then very long slack run no high frictional forces occur in the guide means because the slack run climbs without constraint over the more inclined rope groove flank onto the running face of the drive pulley and runs off over the running face without sliding on fixed housing parts of the rope hoist or pulling apparatus.

Figure 2:
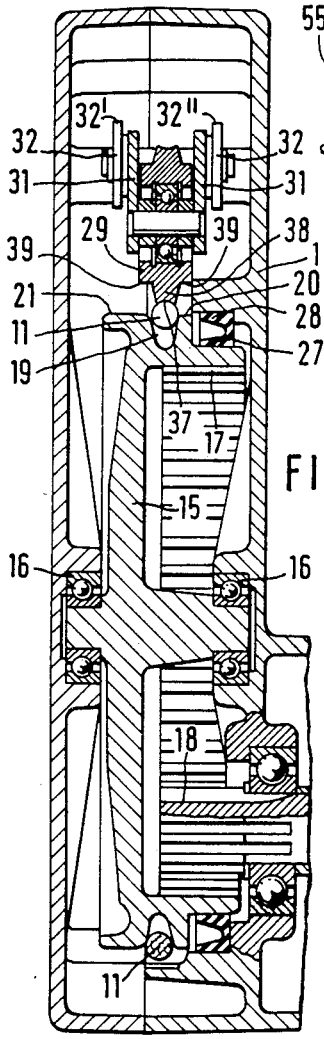
Figure 3:
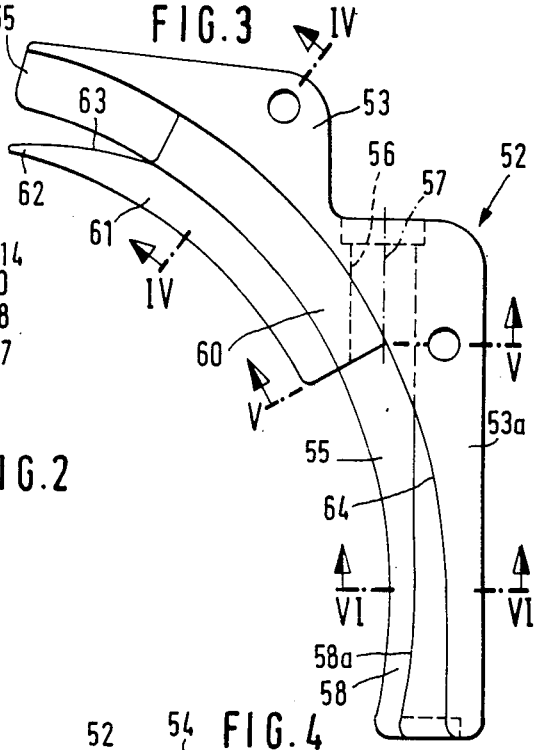
Figure 4:
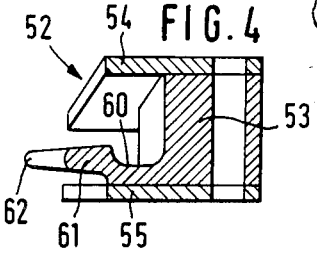
Figure 5:
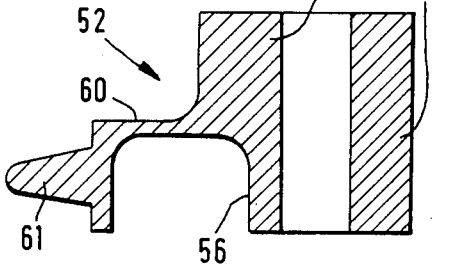
Figure 6:
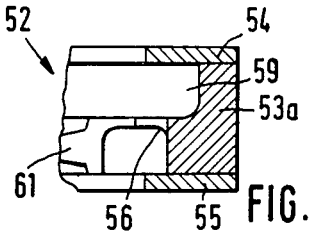
Figure 7:
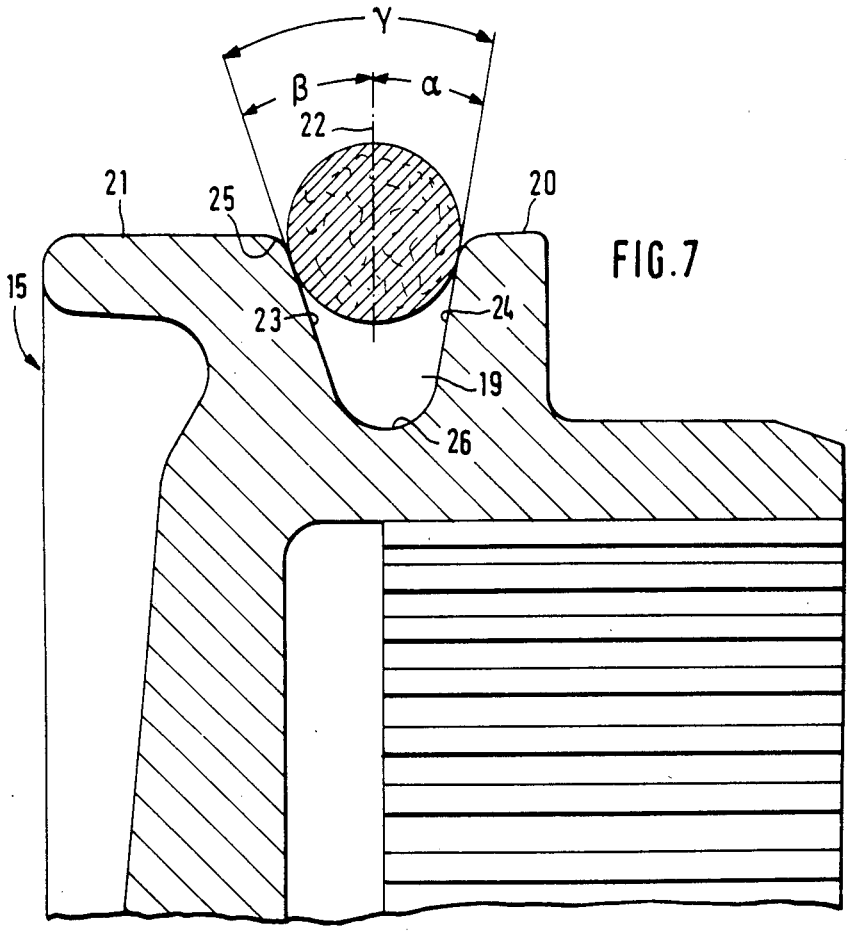

Further features and advantages of the invention will be apparent from the following description and the drawings in which a preferred embodiment of the invention is explained with the aid of an example. In the drawings:

FIG. 1 is a rope hoist apparatus or rope pulling mechanism according to the invention in a lateral view with the housing cover removed, individual parts being shown partially broken away for clarity, FIG. 2 shows the subject of FIG. 1 in cross-section along the line II—II, FIG. 3 shows a detail of FIG. 1 showing the guide means in perpendicualr section, FIG. 4 shows the subject of FIG. 3 in a cross-section along the line IV—IV, FIG. 5 shows the subject of FIG. 3 in a cross-section along the line V—V, FIG. 6 shows the subject of FIG. 3 in a cross-section along the line VI—VI and FIG. 7 is a fragment of FIG. 2 to an enlarged scale which shows the form of the rope groove and the adjoining running face of the drive pulley.

In the drawings 10 denotes a rope hoist apparatus or pulley tackle which operates with a continuous rope 11, which is preferably a wire cable, on the load run 12 of which the load to be raised or lowered is suspended whilst the slack run 13 of the rope 11 is free from load. The housing 14 of the rope hoist apparatus 10 may be suspended at a fixed point, the load hanging on the load run 12 being pulled up or let down with said load run. Conversely, the load run 12 may be secured to a fixed point whilst the housing 14 of the pulley mechanism or rope hoist mechanism is connected to a working platform suspended on the rope which represents the load and with which the rope hoist apparatus runs up and down the rope. For this purpose rope hoist apparatuses of the type according to the invention are preferably used, the slack run 13 leaving the rope hoist apparatus as a rule hanging completely freely downwardly but can be weighted with a weight.

In the housing 14 a drive pulley 15 is rotatably mounted by means of ball bearings 16 and the rope 11 runs round said pulley. The guide pulley 15 has an inner toothing 17 into which a pinion 18 engages which is rotatingly driven by a drive pulley drive not shown in detail here. The drive pulley 15 has an asymmetrical V-shaped rope groove 19 which is shown to a larger scale in FIG. 7. On the one side, the left in FIGS. 2 and 7, of the rope pulley 19 the drive pulley 15 is provided at its outer periphery 20 with a running face 21 which is substantially perpendicular to the drive pulley plane 22 and the purpose of which will be explained in detail hereinafter.

As apparent in particular from FIG. 7 the flank 23 of the rope groove 19 adjacent the running face 21 has a greater inclination to the drive pulley plane 22 than the flank 24 remote from the running face 21. This remote flank 24 may extend parallel to the drive pulley plane 22. Its angle of inclination $\alpha$ to the drive pulley plane 22 is less than the angle of inclination of the opposite flank 23. The edge 25 between the running face 21 and the rope groove flank 23 adjacent thereto is provided with a more pronounced rounding and the rope groove bottom 26 is rounded out.

At the side of the rope groove 19 opposite the running face 21 the outer periphery of the drive pulley 15 has a peripheral shoulder 27 into which a peripheral seal 28 engages which is accomodated in the housing 14 and with which the drive pulley 15 is sealed with respect to the gear oil in which the drive gearing of the drive pulley 15 runs.

As apparent from FIGS. 1 and 2 the rope 11 is pressed at the end of its wrap path by a first pressure roller 29 and a second pressure roller 30 into the rope groove 19 of the drive pulley 15. The pressure rollers 29 and 30 are mounted freely rotatably directly in series on a roller support 31 which in turn is mounted tiltably on a spring-loaded lever 32. The lever 32 is pivotally mounted at its one end **32*a*, the left end in FIG. 1, in the housing 14 and with its other end 32*b*, on the right in FIG. 1, articulately connected to a draw bar 33 which penetrates a stop plate 34 secured to the housing 14 and carries at its lower free end 34*a* an abutment plate 35. The draw bar 33 is surrounded by a strong pressure spring 36 which bears on the one hand on the abutment plate 35 and on the other hand on the bottom of the stop plate 34 and the biasing of which can be adjusted by adjusting the abutment plate 35**.

As apparent in FIG. 2 each pressure roller 29 comprises in the centre region of its peripheral face 37 a narrow radial projection 38 whose width and lateral boundary faces are adapted to the form of the rope groove 19 so that said radial projection can enter the rope groove. Furthermore, each pressure roller 29 and 30 comprises laterally adjacent the radial projection 38 radially set back shoulders 39 with which the pressure rollers 29 and 30 can bear on the outer periphery 20 of the drive pulley 15 or on the running face 21 when the radial projection 38 thereof is completely immersed in the rope groove 10 of the drive pulley 15.

The lever 32, which consists of two portions 32' and 32'' including between them the roller support 31, bears with its right end **32*b* on the stop plate 34 when no rope is in the rope hoist apparatus. In this position the pressure rollers 29 and 30 penetrate with their radial projections 38 into the rope groove 19 but have enough clearance with their shoulders 39 with respect to the running face 21 of the drive pulley 15 for the roller support 31 to be able to execute slight tilting movements about its tilt axis 40. When the roller support 31 assumes the position shown in FIG. 1 in which the second pressure roller 30 bears with its shoulder 39 on the running face 21 of the drive pulley 15, the peripheral face 37 of the radial projection 38 of the first pressure roller 29 is spaced from the rope groove bottom 26 of the groove 19 a distance a which has the same magnitude as the thickness d of the tip 41 of the rope 11**.

It is to be pointed out in this connection that the tip of the wire ropes used with the rope hoist apparatus according to the invention, at which the individual wires of the rope are soldered or welded together, is somewhat thinner than the nominal diameter of the cable or rope. On insertion of the rope 11 in the direction of the arrow 42 the rope runs round the drive pulley 15 which thereby turns in the direction of the arrow 43. The rope tip 41 then passes beneath the first pressure roller 29 and lifts the latter slightly whilst the latter runs onto the further advanced rope increasing in thickness up to its nominal cross-section. The roller carrier 31 thereby pivots on the one hand about the rotation axis of the second pressure roller 30 and on the other hand about the tilt axis 40 in FIG. 1 in the clockwise direction, the tilt axis 40 pivoting the lever 32 about the pivot axis 44 thereof in the anticlockwise direction and lifting said lever against the action of the spring 36 a small amount off the stop 34.

When the drive pulley 15 is now further turned by hand in the direction of the arrow 43 the rope tip 41 moves beneath the peripheral face 37 of the radial projection 38 of the second pressure roller 30. Although the peripheral face 37 of said second pressure roller 30 now has a distance from the rope groove bottom which is less than the thickness d of the rope tip 41, the second pressure roller 30 nevertheless easily climbs onto the rope tip 41 and thereafter onto the following rope of nominal cross-section because the first pressure roller 29, which is of course now already loaded by the spring 36 via the lever 32, exerts an application pressure onto the rope and presses the latter so firmly into the rope groove 19 that the rope tip 41 is pushed with considerable peripheral force beneath the second pressure roller 30.

As soon as the second pressure roller 30 has run onto the rope the latter is under the full application force of the spring 36, the lever 32 assuming the position which is illustrated in dashed line in FIG. 1 and also represented in FIG. 2.

In the upper portion of the housing 14 of the rope hoist apparatus 10 there is an entry tube 45 for the load run 12 and in the lower portion of the housing 14 an exit tube 46 for the load run 13. The two tubes 45 and 46 are secured with sleeves 47 in the upper and lower housing wall 48 and 49 respectively and in parallel tangential planes 50 and 51 respectively follow a guide means which is disposed in the peripheral direction of the drive pulley 15 behind the pressure rollers 29 and 30 and designated as a whole by 52.

The guide means 52 is shown in detail in FIGS. 3 to 6 and consists of a centre casting 53 and two guard plates 54 and 55 covering said casting at the front and rear. The guide means 52 extends substantially over a quarter circle, covers the rope groove 19 and running face 21 of the drive pulley 15 at the periphery and laterally and is secured in the housing 14 in such a manner that its vertical leg **53*a* lies in the tangential planes 50 and 51 in which the load run 12 enters and the slack run 13 of the rope leaves the rope hoist apparatus 10. In the vertical leg 53*a* of the casting 53 there is a vertical entry guide 56 in the form of an entry passage for the load run which is diposed tangentially to the rope groove 19, follows the entry tube 45 and the axis 57 of which lies in the tangential plane 50 in which the load run 12 runs onto the rope groove 19 of the drive pulley 15. In the lower portion of the vertical leg 53*a* the entry passage 56 opens into a first guide passage 58*a* which is opened towards the rope groove 19 and the lateral boundary of which forms a first guide face 58*a* and which at its rear side is covered by the rear guard plate 55 and at the front merges into a second guide passage 59 for the slack run 13 of the rope which is followed by the exit tube 46**.

The second guide passage 59 for the slack run is forwardly offset with respect to the first guide passage 58 for the entering load run 12, i.e. is in a plane which lies in front of the rope groove 19 and in which the running face 21 of the drive pulley 15 is also located. Into this guide passage 59 the slack run 13 lifted out of the pulley groove 19 behind the pressure roller 30 is led via a lateral ramp 60 which is formed in the casting 53 and guides the rope lifted out of the groove 19 sidewards onto the running face 21 of the drive pulley 15. Beneath and partly laterally adjacent the ramp 60 the casting 53 has a tongue 61, the tongue tip 62 of which extends up to the rope groove bottom 26 of the drive pulley 15 and which forms a radial ramp 63 rising in the peripheral direction 43 of the drive pulley 15.

The rope tip 41 and thereafter the rope 11 running round the drive pulley 15 is lifted out by the tongue tip 62, runs over the radial ramp 63 outwardly and is then conducted via the lateral ramp 60 onto the running face 21 of the drive pulley, the rope being conducted at the back via a curved second guide face 64 of the tongue 61 through the guide passage 59 into the exit tube 46.

It can be seen from FIG. 1 that the first guide face **58*a* of the entry passage 58 in the casting 53 is followed by a peripheral guard 65 for the drive pulley 15 which extends up to the pressure rollers 20 and 30 and covers the back of the rope 11 lying in the groove 19**.

The invention is not limited to the embodiment illustrated and described but several modifications and amplifications thereof are possible without leaving the scope of the invention. For example, the spring-loaded lever could also be a rocking lever at the one end of which the roller support is mounted and at the other end of which the spring engages. A stop for the lever a projection could be provided on the housing. It is further possible to form the casting of the guide means in several parts; the essential point is only that the slack run is led into a position parallel to the load run and via the drive pulley itself is conducted into this position so as to subject the rope to the minimum possible sliding friction. The V groove could also be formed somewhat differently; the important point is that the V angle is relatively small so that small application forces suffice to press the rope into the groove and nevertheless enable an adequately high tensile force to be transmitted.

I claim:

1. A rope hoist apparatus comprising a housing, a drive pulley rotatably supported in said housing and having a central plane with a peripheral V-shaped groove, said drive pulley also including a cylindrical running face adjacent the groove, a roller support mounted in said housing for movement in the plane of the drive pulley, at least two pressure rollers rotatably supported in said roller support for movement toward and away from an innermost portion of said V-shaped groove, a rope wrapped around said drive pulley and having a load run in said V-shaped groove and acted upon by said pressure rollers, said rope further including a slack run which is received for a portion of its length on the running face of the pulley, guide means for said slack run, said guide means including an entry end disposed adjacent to said pulley groove, said guide means further including a ramp surface adjacent said entry end and inclined relative said central plane away from said groove, said ramp surface also including an arcuately contoured portion of approximately the same peripheral contour as that of said drive pulley, said ramp surface arcuate portion cooperating with said drive pulley to guide the slack run in order that the slack run pass easily out of the groove and onto the cylindrical running face of the pulley without any pronounced bending of the rope.

2. The apparatus according to claim 1 wherein said entry guide includes a tongue (61), said tongue including a tip (62), said tip provided in tangential relationship and adjacent to the innermost portion of said periperial groove.

3. The apparatus according to claim 2 wherein said pulley groove has a V-shaped cross section taken across the central plane of said drive pulley, said cross sectional shape of said V-shaped groove being asymmetrical with respect to said drive pulley plane and including inclined flanks (23), (24) so inclined relative said plane that the flank (23) adjacent the running face (21) of said drive pulley has a greater angle of inclination with respect to said plane than that of the flank (24) opposite said running face (21).

4. The apparatus according to claim 3 wherein said flank (24) opposite said running face is oriented generally parallel to said drive pulley central plane.

5. The apparatus according to claim 1 wherein said arcuate ramp surface portion taken together with said entry portion of said guide means extends around at least approximately 90° of the 360° extent of said drive pulley.

6. The apparatus according to claim 1 wherein the cylindrical face of said drive pulley is at a radical distance from the axis of rotation of the pulley greater than the radial displacement of the inner portion of the pulley groove itself.

7. The apparatus according to claim 6 further characterized by a exit tube (46) for said slack run, said exit tube oriented tangentially with respect to the arcuate portion of said guide means, said exit tube being oriented at an angular spacing with respect to the pressure rollers of at least approximately 90°, and said load run so wrapped around said drive pulley as to be tangent to the drive pulley adjacent to the point of tangency for said exit tube.

8. The apparatus according to claim 7 further characterized by a spring biasing means acting upon said roller support to urge said pressure rollers toward said V-shaped drive pulley groove, said roller support comprising a lever pivotably supported in said housing.

9. The apparatus according to claim 8 wherein said pressure rollers have a cross sectional configuration complementary to that of said V-shaped groove, and wherein said pressure rollers further include at least one annular shoulder (39), said shoulder being adapted to bear on the cylindrical face of the drive pulley when the pressure roller is provided in the V-shaped pulley groove.

10. The apparatus according to claim 8 wherein at least two pressure rollers are provided on said roller support, one of said pressure rollers having a cross sectional configuration adapted to complement the V-shaped groove of the drive pulley, at least one of said pressure rollers having annular shoulders adapted to bear against the cylindrical face (21) of the drive pulley and against another face (20) of said drive pulley disposed opposite said running face relative said drive pulley central plane.

* * * * *